US009196394B2

(12) United States Patent
Jeker et al.

(10) Patent No.: US 9,196,394 B2
(45) Date of Patent: Nov. 24, 2015

(54) SILICONE MULTILAYER INSULATION FOR ELECTRIC CABLE

(71) Applicant: NEXANS, Paris (FR)

(72) Inventors: Thomas Jeker, Munchenstein (CH); Franz Haner, Busserach (CH); Markus Gasser, Zullwil (CH)

(73) Assignee: NEXANS, Paris (FR)

( * ) Notice: Subject to any disclaimer, the term of this patent is extended or adjusted under 35 U.S.C. 154(b) by 99 days.

(21) Appl. No.: 13/975,953

(22) Filed: Aug. 26, 2013

(65) Prior Publication Data

US 2014/0083739 A1 Mar. 27, 2014

(30) Foreign Application Priority Data

Sep. 25, 2012 (EP) ..... 12306160

(51) Int. Cl.
*H01B 7/02* (2006.01)
*H01B 1/24* (2006.01)

(Continued)

(52) U.S. Cl.
CPC ..... *H01B 7/0225* (2013.01); *H01B 1/24* (2013.01); *H01B 3/46* (2013.01); *H01B 9/027* (2013.01)

(58) Field of Classification Search
CPC ..... H01B 9/02; H01B 7/0225; H01B 7/17; H01B 7/18; H01B 3/441; H01B 7/1825; H01B 7/041; H01B 7/0063; H01B 7/183; H01B 7/14; H01B 7/292; H01B 1/04; H01B 11/10; H01B 11/1066; H01B 11/1895; H01B 11/1008; H01B 11/1808; H01B 12/02; H01B 12/06; H01B 12/12; H01B 12/14; H01B 12/16; D02G 3/00; B05C 7/08; B05D 1/02; B25J 11/0075; B25J 5/007; B29C 63/32; B82Y 30/00; C08L 23/04; C08L 23/0853; C08L 23/10; C08L 67/00; C08L 77/02; C08L 77/06; C08L 2205/02; C08L 2205/03; C08L 65/00; C08G 2261/332; D07B 1/02; D07B 2201/102; D07B 2201/10; D07B 2501/2023; D07B 7/18; E04C 5/122; E04C 5/127; F16L 53/007; F16L 55/1645; F16L 55/1655; Y10T 428/2982; Y10T 403/7058; Y10T 403/7064

USPC ..... 156/56; 174/84, 102 R, 105 R, 155, 120, 174/115, 110 R; 524/538; 428/402, 364; 57/258; 52/223.13, 745.19, 745.2; 403/371, 374; 338/214, 66; 427/236; 180/21; 118/318

See application file for complete search history.

(56) References Cited

U.S. PATENT DOCUMENTS 3,047,448 A * 7/1962 Feller et al. ..... 156/56
3,258,522 A * 6/1966 Bartos et al. ..... 174/84 R (Continued)

FOREIGN PATENT DOCUMENTS

GB 870583 6/1961
GB 870583 A * 6/1961 ..... H01B 9/02
GB 870583 A * 6/1961

OTHER PUBLICATIONS

Search Report dated Feb. 2013.

*Primary Examiner* — Timothy Thompson
*Assistant Examiner* — Guillermo Egoavil
(74) *Attorney, Agent, or Firm* — Sofer & Haroun, LLP

(57) ABSTRACT

An electric cable made from at least one elongated electric conductor and a multilayer insulation surrounding the electric conductor. The multilayer insulation has a first semiconducting layer and an electrically insulating layer, where the two layers are made from a silicone rubber based composition. The semiconducting silicone rubber based composition of the first semiconducting layer has carbon rovings as conductive filler.

17 Claims, 2 Drawing Sheets

(51) Int. Cl.
*H01B 9/02* (2006.01)
*H01B 3/46* (2006.01)

(56) References Cited

U.S. PATENT DOCUMENTS 4,366,464 A * 12/1982 Miyamoto et al. ..... 338/214
5,008,488 A * 4/1991 Nakagawa ..... 174/36
5,713,169 A * 2/1998 Meier et al. ..... 52/223.13
7,179,522 B2 * 2/2007 Hiel et al. ..... 428/300.7
7,847,191 B2 * 12/2010 Swift et al. ..... 174/110 R
2002/0150757 A1 * 10/2002 Luigi et al. ..... 428/375
2004/0020686 A1 * 2/2004 Perez et al. ..... 174/155
2006/0182961 A1 * 8/2006 Person et al. ..... 428/364
2006/0280938 A1 12/2006 Atkinson
2007/0044992 A1 * 3/2007 Bremnes ..... 174/102 R
2007/0256852 A1 * 11/2007 Cardinaels et al. ..... 174/74 A
2010/0216333 A1 * 8/2010 Hane et al. ..... 439/502
2011/0192132 A1 * 8/2011 Kimura et al. ..... 57/258
2011/0203835 A1 * 8/2011 Yamamoto et al. ..... 174/250
2011/0266023 A1 * 11/2011 Doneker et al. ..... 174/105 R
2012/0111603 A1 * 5/2012 Cofre et al. ..... 174/115
2012/0164429 A1 * 6/2012 Shah et al. ..... 428/293.1
2012/0171496 A1 * 7/2012 Esseghir et al. ..... 428/423.1
2013/0295308 A1 * 11/2013 Kumazawa et al. ..... 428/36.9
2014/0287176 A1 * 9/2014 Galloway ..... 428/36.4
2014/0288229 A1 * 9/2014 Sotokawa et al. ..... 524/538

* cited by examiner

SILICONE MULTILAYER INSULATION FOR ELECTRIC CABLE

RELATED APPLICATION

This application claims the benefit of priority from European Patent Application No. 12 306 160.8, filed on Sep. 25, 2012, the entirety of which is incorporated by reference.

BACKGROUND

1. Field of the Invention

The present invention relates to an electric cable including a multilayer insulation made from silicone rubber, as well as a manufacturing process of said electric cable.

More particularly, it applies typically, but not exclusively, to the fields of power cables, such as medium voltage (especially from 5 kV to 45-60 kV) or high voltage (especially greater than 60 kV, which may be up to 800 kV) power cables, whether they are direct voltage (DC) or alternative voltage (AC) cables.

2. Description of Related Art

Medium voltage or high voltage power cables typically comprise a central electric conductor and, successively and coaxially around this electric conductor, a semiconducting inner layer, an electrically insulating (intermediate) layer and a semiconducting outer layer. These three layers can be crosslinked via techniques that are well known to those skilled in the art.

GB 870 583 describes a 3-layer crosslinked insulation for an electric cable, comprising a semiconducting inner layer, an electrically insulating (intermediate) layer and a semiconducting outer layer. Said three layers are made from vinyl-containing silicone gum. The semiconducting layers of said electric cable are made from a composition comprising vinyl-containing silicone gum, an organic peroxide as crosslinker, and acetylene black as conductive filler.

However, this process is not optimized to reduce significantly partial discharges between the electrical insulating layer and the semiconducting layers, when a voltage level of at least 5 kV is applied to the electric cable. Indeed, the use of conductive filler of carbon black type (e.g. acetylene black) can involve the formation of gas bubbles at the interface between the semiconducting layer and the electrically insulating layer. Said bubbles can be formed during the fabrication of the semiconducting layer, wherein carbon black can react with the silicone gum and/or the crosslinker, in forming said bubbles.

OBJECTS AND SUMMARY

The aim of the present invention is to overcome the drawbacks of the prior art by proposing an electric cable comprising:

at least one elongated electric conductor, and a multilayer insulation surrounding said electric conductor, said multilayer insulation comprising a first semiconducting layer and an electrically insulating layer, said two layers being made from a silicone rubber based composition, characterized in that the first semiconducting layer is made from a silicone rubber based composition comprising carbon rovings as conductive filler.

The use of carbon ravings as conductive filler in the semiconducting layer of the multilayer insulation allows advantageously to limit significantly the presence of air and/or the presence of space between the layers of the insulation.

Hence, the multilayer insulation of the present invention allows advantageously to decrease partial discharges in the electric cable, while guaranteeing good flexibility properties.

In a preferred embodiment, the first semiconducting layer can surround the elongated electric conductor, and said electrically insulating layer can surround the first semiconducting layer.

In another preferred embodiment, the multilayer insulation can comprise a second semiconducting layer made from a silicone rubber based composition, to form a 3-layer insulation.

More particularly, the first semiconducting layer can be surrounded by the electrically insulating layer, and the electrically insulating layer can be surrounded by the second semiconducting layer.

The silicone rubber based composition, used to obtain the second semiconducting layer, can advantageously comprise carbon rovings as conductive filler.

The silicone rubber based composition(s) used to obtain the first semiconducting layer, and optionally the second semiconducting layer, include an amount of conductive filler, and more preferably an amount of carbon rovings, sufficient to make semiconducting the silicone rubber based composition.

In addition, the amount of conductive filler in the silicon rubber based composition should preferably allow the composition to be extruded.

It is more particularly considered that a layer is semiconducting when its specific electric conductivity is at most of $1.10^9$ Ωm (ohm centimeter).

The silicone rubber based composition used to obtain a semiconducting layer may comprise at most 60% by weight of (electrically) conductive filler, preferably at most 50% by weight of conductive filler, preferably at most 40% by weight of conductive filler.

In another embodiment, the silicone rubber based composition used to obtain a semiconducting layer may comprise at least 0.1% by weight of (electrically) conductive filler, preferably at least 10% by weight of conductive filler, and even more preferentially at least 20% by weight of conductive filler.

The carbon rovings of the present invention are more particularly bundles of carbon fibers.

In a particular embodiment, the carbon rovings can include a first type of carbon rovings with a first length, and/or a second type of carbon rovings with a second length, the first length being more particularly different from the second length.

In a preferred embodiment, the carbon ravings includes said first type of carbon rovings with a first length, and said second type of carbon rovings with a second length. The second length can be at least ten times superior to the first length.

The carbon rovings can be cut to obtain the desired length.

The first length of the first type of carbon rovings can go from 50 to 300 μm, and more preferably can be around 220 μm.

The second length of the second type of carbon rovings can go from 1 to 10 mm, and more preferably can go from 3 to 6 mm.

The composition can comprises at least 2% by weight of the first type of carbon ravings and/or at least 10% by weight of the second type of carbon rovings.

The conductive filler of the present invention can only be carbon rovings, or a mixture of carbon ravings with other type(s) of conductive filler chosen preferably from carbon blacks, conductive carbon, and metal particles, or one of their mixtures.

The conductive carbon blacks can be selected from any of the carbon blacks listed in ASTM D-1765-76, furnace black, acetylene black, thermal black, lamb black and Ketjen black, or one of their mixtures.

The conductive carbon, as distinguished from conductive carbon black, includes at least one of carbon nanotubes, fullerene, grapheme, graphites and expanded graphite platelets. The average particle size of such conductive carbon can typically be of nano-scale proportions.

The conductive metal particles include granules, powder, fibers, platelets, and the like. These metal particles typically have an average particle size of 0.1 to 100, mare typically 0.3 to 30, microns as measured by X-ray line broadening. The metal particles may have any particle shape desired although, as is known, the shape selection may depend upon the intended end use of the metal-filled product. Spherical shapes, platelets, prismatic shapes, whiskers, and the like, can be used.

Metals that can be used as a conductive filler include, alone or in admixture with one or more other such metals, or as finely powdered alloys, aluminum, indium, tin, lead, bismuth, as well as Groups II-B through VII-B elements of the Periodic System including such as zinc, cadmium, scandium, titanium, zirconium, vanadium, chromium, molybdenum, tungsten, manganese, rhenium, iron, ruthenium, osmium, cobalt, rhodium, iridium, nickel, palladium, platinum, and the like. Particularly satisfactory for convenience and relative cheapness are aluminum, zinc, iron, nickel, tin, lead, and silver. Copper, while conductive, may in its metallic form be objectionable in some rubber compounding formulations.

In a preferred embodiment, the first semiconducting layer and the electrically insulating layer are co-extruded layers.

The coextruded multilayer insulation allows advantageously to optimize the reduction of partial discharges in the electric cable, while guaranteeing good flexibility properties.

The term "co-extruded layers" means that the extrusion of the layers of the multilayer insulation may occur simultaneously, more particularly in using the same extrusion head (i.e. only one extruder head).

When the cable is said 3-layer insulation, the first semiconducting layer, the electrically insulating layer and the second semiconducting layer can be co-extruded layers.

The silicone rubber (i.e. silicone gum) used in the present invention is an elastomer (rubber-like material) composed of silicone polymer containing silicon together with carbon, hydrogen, and oxygen. The silicone rubber is usually named as polysiloxane, and more particularly a polyorganosiloxane.

More particularly, the backbone of the silicone rubber comprises Si—O—Si units.

The silicone rubber based composition may comprise more than 50.0 parts by weight of silicone rubber per 100 parts by weight of polymer(s) (i.e. polymer matrix) in the composition, preferably at least 70 parts by weight of silicone rubber per 100 parts by weight of polymer(s) in said composition, and particularly preferably at least 90 parts by weight of silicone rubber per 100 parts by weight of polymer(s) in said composition.

In a particularly advantageous manner, the silicone rubber based composition comprises a polymer matrix that is composed solely of a silicone rubber or a mixture of silicone rubbers. One thus talks about silicone rubber matrix as such.

The silicone rubber based composition(s) of the present invention can be crosslinkable (i.e. vulcanizable) silicone rubber based composition(s).

In a particular embodiment of the invention, at least one layer of the multilayer insulation, more preferably at least two layers of the multilayer insulation, and more preferably the layers (i.e. the first semiconducting layer and the electrically insulating layer, or the first semiconducting layer, the electrically insulating layer, and the second semiconducting layer) of the multilayer insulation, is/are crosslinked layer(s) (i.e. vulcanized layer(s)).

In this respect, the silicone rubber based composition of the invention may be crosslinked by process well-known in the art to crosslink silicone rubber, such as for example in using peroxides, sulfur systems, metallic oxides, etc According to peroxide crosslinking, the silicone rubber based composition can further comprise organic peroxide, and more particularly not more than 2.00 parts by weight of organic peroxide per 100 parts by weight of polymer(s) in the composition.

Other additives and/or fillers that are well known to those skilled in the art may also be added to the silicone rubber based composition of the invention, such as breakdown retardants; processing aids such as lubricants or waxes; compatibilizers; couplers; UV stabilizers; and/or non-conductive fillers.

In one particular embodiment, when the multilayer insulation is the 3-layer insulation, the multilayer insulation is designed so that the electrically insulating layer is directly in physical contact with the first semiconducting layer, and the second semiconducting layer is directly in physical contact with the electrically insulating layer.

In a preferred embodiment according to the present invention, the multilayer insulation is surrounded by a metal shield.

Said metal shield is arranged around and along the multilayer insulation.

This metal shield may be:

- a "wire" shield, composed of an assembly of copper or aluminum conductors surrounding the second semiconducting layer,
- a "strip" shield composed of one or more conducting metal strips laid spirally around the second semiconducting layer, or
- a "leaktight" shield such as a metal tube surrounding the second semiconducting layer. This latter type of shield makes it possible especially to form a barrier to the moisture that has a tendency to penetrate the electric cable in the radial direction.

Combining with the co-extruded multilayer insulation, the metal shield of the present invention allows advantageously to decrease in a more significant manner partial discharges in the electric cable.

The metal shield may as well serve for earthing the electric cable and may thus transport fault currents, for example in the case of a short-circuit in the network concerned.

Finally, thanks to the metal shield, the electric cable can be placed everywhere, for example on a metallic ground, so that it render the electric cable easy to install and to use.

Furthermore, the electric cable of the invention may comprise an outer protective sheath surrounding the multilayer insulation, or alternatively more particularly surrounding said metal shield, when it exists. This outer protective sheath may be conventionally made from suitable thermoplastic materials such as HDPE, MDPE or LLDPE; or alternatively flame-propagation-retardant materials or fire-propagation-resistant materials. In particular, if the latter materials do not contain halogen, this sheath is referred to as being of HFFR type (Halogen Free Flame Retardant).

Other layers, such as layers that swell in the presence of moisture, may be added between the multilayer insulation and the metal shield when it exists, and/or between the metal shield and the outer sheath when they exist, these layers providing longitudinal and/or transverse leaktightness of the electric cable to water. The electric conductor of the cable of the invention may also comprise materials that swell in the presence of moisture to obtain a "leaktight core".

The electric cable of the present invention can be more particularly a power cable supporting a voltage level of at least 5 kV. It can be a direct voltage (DC) or alternative voltage (AC) cable.

More preferably, the electric cable can support a voltage level from 5 kV to 45-60 kV for medium voltage cable, or a voltage level greater than 60 kV, which may be up to 800 kV, for high voltage cable.

Another object of the present invention is a process for manufacturing the electric cable as described in the present invention, characterized in that the process comprises the step of co-extruding the layers (i.e. the first semiconducting layer and the electrically insulating layer, or the first semiconducting layer, the electrically insulating layer, and the second semiconducting layer) of the multilayer insulation according to the invention.

More particularly, the layers of the multilayer insulation can be extruded simultaneously.

More preferably, the simultaneous extrusion can be done with the same extrusion head.

To co-extrude the compositions aiming at forming respectively the different layers of the multilayer insulation of the electric cable of the invention, said compositions are extruded in using one extruder per composition in order to flow until the same extrusion head in which said compositions are gathered to be co-extruded.

BRIEF DESCRIPTION OF DRAWINGS

Other characteristics and advantages of the present invention will emerge in the light of the description of non-limiting examples, given with reference to figures according to the invention, wherein.

DETAILED DESCRIPTION

For reasons of clarity, only the elements that are essential for understanding the invention have been schematically represented, and without being drawn to scale.

The electric cable of the present invention can include an elongated central conducting element, especially made of copper or aluminum, surrounded by an extruded semiconducting layer, said extruded semiconducting layer being surrounded by an extruded electrically insulating layer, so that a 2-layer insulation is obtained.

The semiconducting layer can be made from a silicone rubber composition commercialized by the company RADO under the reference Silopren 2270H, wherein carbons rovings have been mixed. The mixture can be done with a roll or a mixer. Said silicone rubber composition mixed with carbon rovings is then extruded in using an extruder, around the elongated central conducting element.

In a first example (example 1), said carbon rovings have a length 200 μm and are commercialized by the company Suter-Kunststoffe, under the reference "760,0001 SCS Carbon-Kurzschnitt". Said silicone rubber composition comprises around 10% by weight of said carbon rovings.

In a second example (example 2), said carbon rovings have a length 6 mm and are commercialized by the company Suter-Kunststoffe, under the reference "211,6100 SCS Carbon-Kurzschnitt". Said silicone rubber composition comprises around 4% by weight of said carbon rovings.

In a third example (example 3), said carbon rovings includes 50% by weight of carbon rovings of example 1, and 50% by weight of carbon rovings of example 2. Said silicone rubber composition comprises around 20% by weight of carbon rovings in totality (i.e. carbon rovings of example 1 and carbon rovings of example 2).

The electrically insulating layer can be made from a silicone rubber composition commercialized by the company RADO under the reference Silopren 2270H. Said silicone rubber composition is extruded in using an extruder, around the semiconducting layer.

These two compositions (cf. the silicone rubber composition to get the semiconducting layer, and the silicone rubber composition to get the electrically insulating layer, according to examples 1, 2 or 3) can be co-extruded in using an extruded head. In said extruder head, said two compositions go through the same extrusion head extremity.

In said extrusion head extremity, said two compositions are applied simultaneously around the elongated central conducting element, to form respectively the coextruded layers around said elongated central conducting element.

Hence, there is substantially no air bubble between the interface of the semiconducting layer and the electrically insulating layer, so that said 2-layer insulation allows advantageously to decrease partial discharges in the electric cable, while guaranteeing good flexibility properties.

Figure 2:
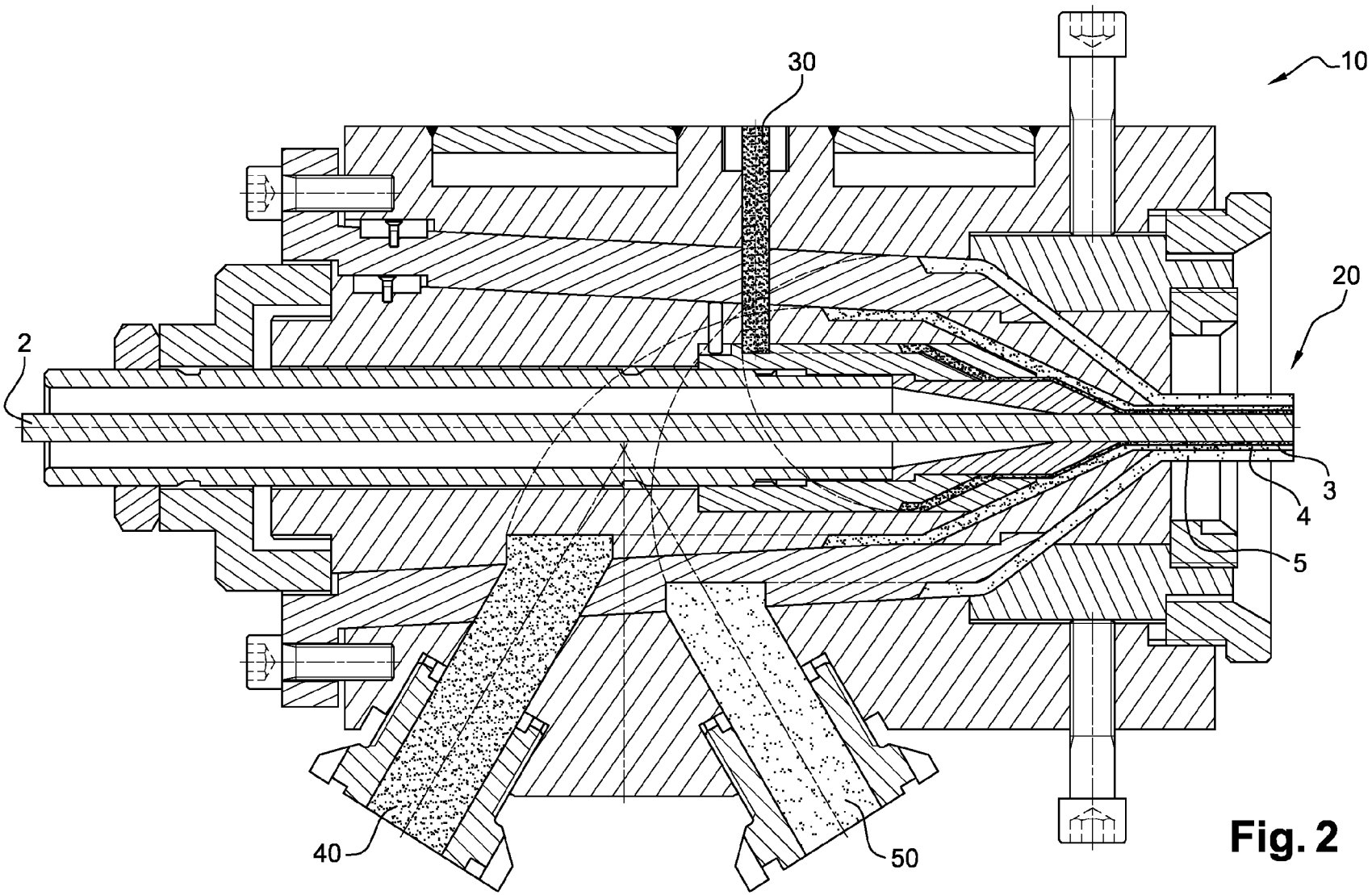
FIG. 2 shows an extrusion head to co-extrude a multilayer insulation to form an electric cable according to the invention.

To better understand the co-extrusion process, FIG. 2 thereafter will show in details the co-extrusion process for a 3-layer insulation.

Figure 1:
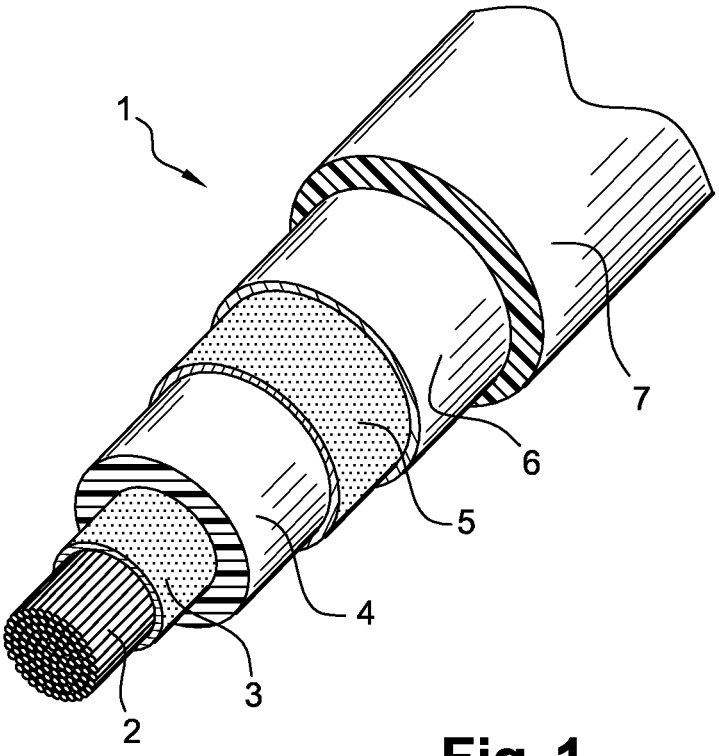
FIG. 1 shows a schematic view in perspective and in cross section of an electric cable according to the invention.

The FIG. 1 illustrates a particular embodiment of the electric cable of the present invention.

FIG. 1 represents a power cable 1 comprising an elongated central conducting element 2, especially made of copper or aluminum. Successively and coaxially around this conducting element 2, the power cable 1 also comprises a first extruded semiconducting layer 3 known as the "inner semiconducting layer", an extruded electrically insulating layer 4, a second extruded semiconducting layer 5 known as the "outer semiconducting layer", a metal shield 6, and an outer protective sheath 7.

The first semiconducting layer and the second semiconducting layer can be obtained from one of the silicone rubber semiconducting composition as described above (see examples 1, 2 or 3).

The electrically insulating layer can be made from a composition commercialized by the company RADO under the reference Silopren 2270H.

The three layers 3, 4 and 5 can be co-extruded layers according to the invention.

The presence of the metal shield 6 is preferential.

The presence of the protective outer sheath 7 is preferential, but not essential.

The co-extrusion process of the layers 3, 4 and 5 of FIG. 1 is illustrated in FIG. 2.

FIG. 2 shows the co-extrusion process of:

- a first silicone rubber semiconducting composition 30, which is the silicone rubber composition mixed with carbon rovings, as described previously;
- a silicone rubber electrically insulation composition 40, which is the composition as described previously (cf. the Silopren 2270H composition as such); and a second silicone rubber semiconducting composition 50, which is identical to the first silicone rubber semiconducting composition.

Said three compositions 30, 40 and 50 flow respectively from three different extruders (not represented) to the inside of an extrusion head 10.

The three different extruders may be extruders well-known in the art.

The extruder head 10 is commercialized by the company under ITAL under the reference TECA/35, used for three-layer extrusion.

In said extruder head 10, said three compositions 30, 40 and 50 go through the same extrusion head extremity 20.

In said extrusion head extremity 20, the compositions 30, 40 and 50 are applied simultaneously around the elongated central conducting element 2, to form respectively the coextruded layers 3, 4 and 5 around said elongated central conducting element.

Hence, there is substantially no air bubble between the interface of the layers 3 and 4, and between the interface of the layers 4 and 5, so that said 3-layer insulation allows advantageously to decrease partial discharges in the electric cable, while guaranteeing good flexibility properties.

The invention claimed is:

1. Electric cable comprising:

at least one elongated electric conductor, and a multilayer insulation surrounding said electric conductor, said multilayer insulation having a first semiconducting layer and an electrically insulating layer, said two layers being made from a silicone rubber based composition, wherein the first semiconducting layer is obtained from a silicone rubber based composition having carbon rovings as conductive filler, the carbon rovings includes a first type of carbon rovings with a first length, and/or a second type of carbon rovings with a second length.

2. Electric cable according to claim 1, wherein the first semiconducting layer surrounds the elongated electric conductor, and said electrically insulating layer surrounds the first semiconducting layer.

3. Electric cable according to claim 1, wherein the multilayer insulation further comprises a second semiconducting layer made from a silicone rubber based composition, to form a 3-layer insulation.

4. Electric cable according to claim 3, wherein the first semiconducting layer is surrounded by the electrically insulating layer, and the electrically insulating layer is surrounded by the second semiconducting layer.

5. Electric cable according to claim 1, wherein the second length is at least ten times superior to the first length.

6. Electric cable according to claim 1, wherein the first length goes from 50 to 300 μm.

7. Electric cable according to claim 1, wherein the second length goes from 1 to 10 mm.

8. Electric cable according to claim 1, wherein the composition comprises at least 2% by weight of the first type of carbon rovings and/or at least 10% by weight of the second type of carbon rovings.

9. Electric cable according to claim 1, wherein the first semiconducting layer and the electrically insulating layer are co-extruded layers.

10. Electric cable according to claim 3, wherein the first semiconducting layer, the electrically insulating layer and the second semiconducting layer are co-extruded layers.

11. Electric cable according to claim 1, wherein at least one of the layers of said multilayer insulation is a crosslinked layer.

12. Electric cable according to claim 1, wherein the multilayer insulation is surrounded by a metal shield.

13. Electric cable according to claim 1, wherein the electric cable is a power cable supporting a voltage level of at least 5 kV.

14. Electric cable according to claim 6, wherein the first length is around 220 μm.

15. Electric cable according to claim 7, wherein the second length goes from 3 to 6 mm.

16. Electric cable according to claim 11, wherein the layers of said multilayer insulation are crosslinked layers.

17. Electric cable comprising:

at least one elongated electric conductor, and a multilayer insulation surrounding said electric conductor, said multilayer insulation having a first semiconducting layer and an electrically insulating layer, said two layers being made from a silicone rubber based composition, wherein the first semiconducting layer is obtained from a silicone rubber based composition having carbon rovings as conductive filler, said carbon rovings including at least carbon rovings having a first length from 50 to 300 μm, and/or at least carbon rovings having a second length from 1 to 10 mm.

* * * * *